US009415979B2

(12) United States Patent
Baumann et al.

(10) Patent No.: US 9,415,979 B2
(45) Date of Patent: Aug. 16, 2016

(54) HIGH SPEED, REDUCED CLEARANCE LIFT

(71) Applicant: NAUTICAL STRUCTURES INDUSTRIES, INC., Largo, FL (US)

(72) Inventors: James A. Baumann, Tampa, FL (US); Robert Bolline, St. Petersburg, FL (US); Scott L. Danforth, Bradenton, FL (US); Sunthorn Ingersoll, Tampa, FL (US)

(73) Assignee: NAUTICAL STRUCTUTRES INDUSTRIES, INC., Largo, FL (US)

( * ) Notice: Subject to any disclaimer, the term of this patent is extended or adjusted under 35 U.S.C. 154(b) by 56 days.

(21) Appl. No.: 14/481,426

(22) Filed: Sep. 9, 2014

(65) Prior Publication Data

US 2016/0068374 A1 Mar. 10, 2016

(51) Int. Cl.

| | |
|---|---|
| ***A47F 5/00*** | (2006.01) |
| ***B66C 23/52*** | (2006.01) |
| ***B63B 27/10*** | (2006.01) |

(52) U.S. Cl.

CPC ..... *B66C 23/52* (2013.01); *B63B 27/10* (2013.01)

(58) Field of Classification Search

USPC ..... 248/644, 651, 652, 653, 654, 125.8

See application file for complete search history.

(56) References Cited

U.S. PATENT DOCUMENTS

| | | | | |
|---|---|---|---|---|
| 4,667,354 | A * | 5/1987 | Carey, Jr. | A61G 1/0212 248/654 |
| 4,722,044 | A * | 1/1988 | Heiser | E02F 9/2037 414/700 |
| 4,872,363 | A * | 10/1989 | Rosenthal | B23Q 1/48 248/653 |
| 5,028,180 | A * | 7/1991 | Sheldon | B23Q 1/5462 248/631 |
| 5,709,362 | A * | 1/1998 | Clarke | B60S 9/10 248/188.5 |
| 2002/0017595 | A1 * | 2/2002 | Koyanagi | A47B 23/04 248/122.1 |

* cited by examiner

*Primary Examiner* — Steven Marsh

(74) *Attorney, Agent, or Firm* — Larson & Larson, P.A.; Frank Liebenow; Patrick Reid

(57) ABSTRACT

A high speed, reduced clearance lift has a lift platform that is raised and lowered by operation of a telescoping hydraulic ram that has at least three telescoping sections, such that, the retracted height of the telescoping hydraulic ram is minimized while the deployed height of the telescoping hydraulic ram is such that the lift platform is lifted the height needed to, for example, lift a device out of the hull of a watercraft. To better stabilize the lift platform both in the retracted and deployed positions, locks, preferably in the form of actuated locking pins, interface with receivers mounted in a frame in which the lift platform travels. In such, when the locking pins are extended into the receivers, the lift platform and any payload resting on the lift platform are held steady without the need for hydraulic pressure.

13 Claims, 5 Drawing Sheets

HIGH SPEED, REDUCED CLEARANCE LIFT

FIELD

This invention relates to the field of lifts and more particularly to a system for compact, high speed deployment from a watercraft.

BACKGROUND

There are many lift mechanisms in use today. Elevators are one form, lifting and lowering people and other loads, usually within buildings. Another form of lift is a hydraulic lifts that is used to raise vehicles in service stations, allowing mechanics to work from beneath the vehicles. Jacks are also lifts that raise vehicles allowing for changing of tires. The list continues, but in general, the lift mechanisms in use today make space/speed tradeoffs that limit usability in certain applications such as watercraft.

For example the hydraulic lifts used to hoist vehicles in your neighborhood garage performs well for its intended purpose, but will not perform well as a lift on a watercraft for several reasons. The first reason is speed. Such lifts are very slow. In many at-sea situations, there are often reasons for quick operation. It is often important to deploy a life raft or return a dingy to the deck and due to emergencies or high surf, the operation must be performed relatively quickly without precluding the use of a service station type of lift that often requires several minutes to lift an object eight feet.

The next reason why a garage-type lift will not function in a watercraft is vertical displacement. For example, to lift a vehicle eight feet, the hydraulic cylinder must be set at least eight feet into the floor, and likely at least ten feet. This is easily accomplished beneath the floor of a service station, but in many of watercraft, there is insufficient clearance between the deck of the watercraft and the hull of the watercraft. Many a watercraft do not have sufficient vertical displacement for a garage-type lift, especially in areas of the watercraft towards the bow where the hull slopes upward, closer to the deck, for cutting through waves.

The next reason why a garage-type lift will not function in a watercraft is weight. The overall weight of such a hydraulic cylinder and the hydraulic fluid needed to lift the requisite distance will be a burden to many a watercraft and even if the watercraft is large enough to support the weight, the excess weight will impact fuel economy and the ability to bring the watercraft up on plane.

Another reason why a garage-type lift will not function in a watercraft is stability. Such a lift operates well on stable ground, but in a watercraft, wave motion and winds create instability. When operating certain payloads on a garage-type lift within a watercraft, stability is often required. For example, when extending a hoist to lift a dingy out of the sea, sudden movement of the hoist due to movement of the lift mechanism is often disastrous. Certain movement results in damage to the dingy and/or sinking of the dingy.

Other lift mechanisms are not suited for watercraft for similar or different reasons. For example, elevators are not practical because such require overhead pulley systems which are not feasible on most watercraft.

What is needed is a lift system that will quickly deploy and retract a payload while occupying minimal vertical space and adding minimal weight to a vehicle such as a watercraft.

SUMMARY

In one embodiment, a high speed, reduced clearance lift system is disclosed including a lift platform and a lift frame for guiding and containing the lift platform. A telescoping hydraulic ram having at least three telescoping sections has a first end interfaced to the lift platform and a second end interfaced to a structural member such that, hydraulic fluid pressure introduced into the telescoping hydraulic ram forces the at least three telescoping sections to extend, thereby raising the lift platform into a deployed position, and abatement of the hydraulic fluid pressure allows the at least three telescoping sections to collapse, thereby lowering the lift platform to a retracted position.

In another embodiment, a method of deploying/retracting a payload from beneath a deck of a watercraft is disclosed. The method includes interfacing a first end of a telescoping hydraulic ram to a lift platform, interfacing a second, distal end of the telescoping hydraulic ram to a structure of the watercraft, and mounting the payload onto a lift platform. Fluid pressure is then forced into the telescoping hydraulic ram, thereby extending telescoping sections of the telescoping hydraulic ram and moving the payload from a retracted position into an extended position. Likewise, upon abatement of the fluid pressure, the payload moves from the extended position into the retracted position.

In another embodiment, a high speed, reduced clearance lift system for a watercraft is disclosed that includes a lift platform held within a lift frame. The lift frame guides and contains the lift platform and the lift frame is structurally interfaced to a hull of a watercraft. A telescoping hydraulic ram having at least three telescoping sections has a first end interfaced to a bottom of the lift platform and a second end interfaced to the hull of the watercraft. Hydraulic fluid pressure introduced into the telescoping hydraulic ram forces the at least three telescoping sections to extend, thereby raising the lift platform into a deployed position. Abatement of the hydraulic fluid pressure allows the at least three telescoping sections to collapse, thereby lowering the lift platform to a retracted position. Locking pin receivers are interfaced to the frame in a location where the lift platform rests when the frame is in the deployed position and locking pins are interfaced to sides of the lift platform, each of the locking pins actuated to removably engage with a corresponding one of the plurality of locking pin receivers when the lift platform is in the deployed position. The locking pins and locking pin receivers hold the lift platform steady during, for example, rough seas.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
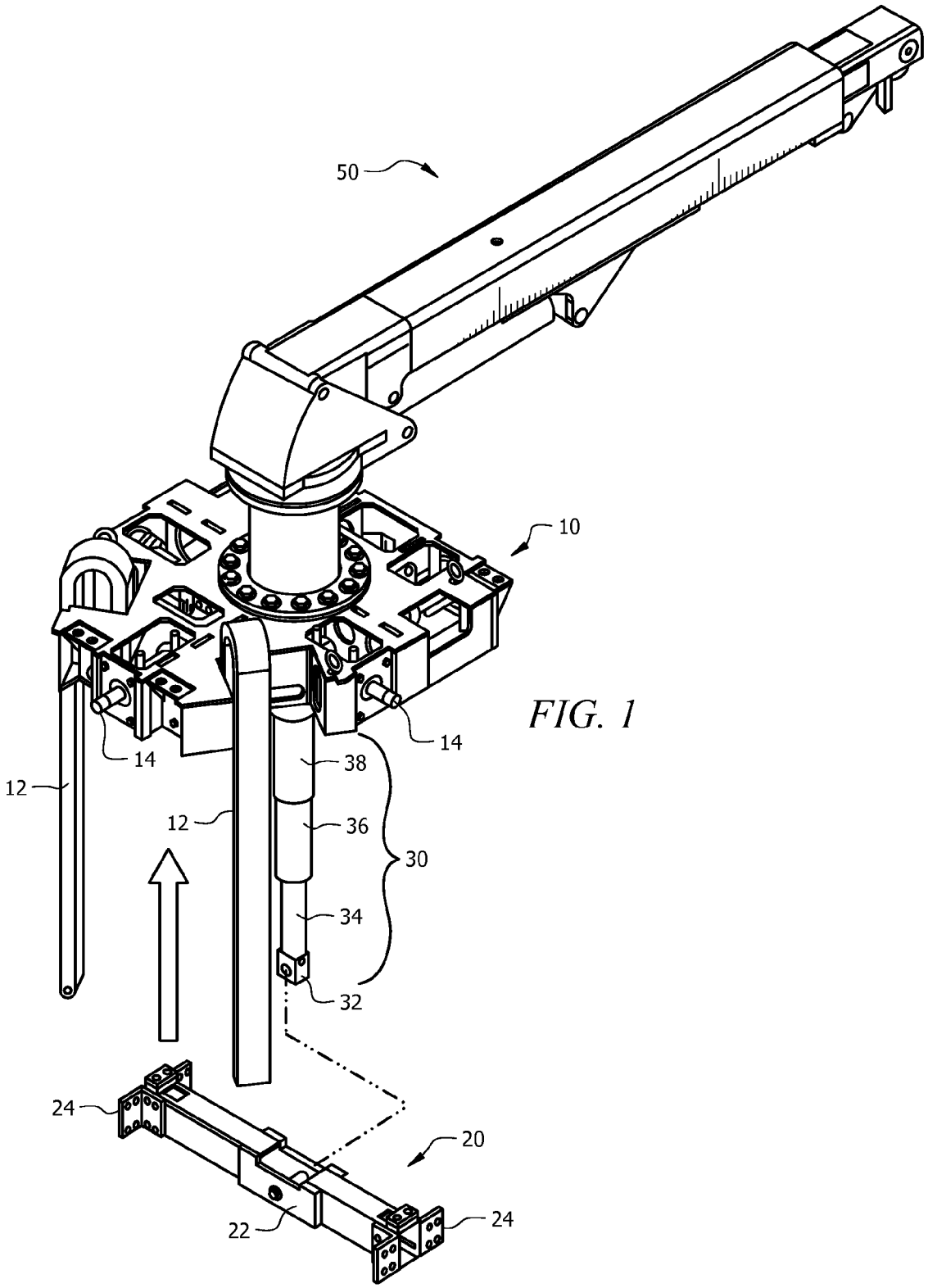
FIG. 1 illustrates a perspective view of the moving components of the high-speed, reduced clearance lift.

Reference will now be made in detail to the presently preferred embodiments of the invention, examples of which are illustrated in the accompanying drawings. Throughout the following detailed description, the same reference numerals refer to the same elements in all figures.

Throughout the description, a crane 50 is used as an example of a payload 50, but there is no limitation to any particular payload 50. Any conceivable payload is anticipated, especially high energy payloads, transmitting forces in any axis. Some anticipated loads include hoists, cranes, cargo, vehicles, arms, etc. Additionally, in some configurations, the payload 50 is not attached to the lift platform 10, for example when moving cargo in or out of the hull of a watercraft.

Referring to FIG. 1, a perspective view of the moving components of the high-speed, reduced clearance lift is shown. In this example, a high-speed, reduced clearance lift platform 10 is attached to deploy/retract a crane 50, which is an example of a particular payload. Again, it is noted that many other payloads are anticipated.

Figure 2:
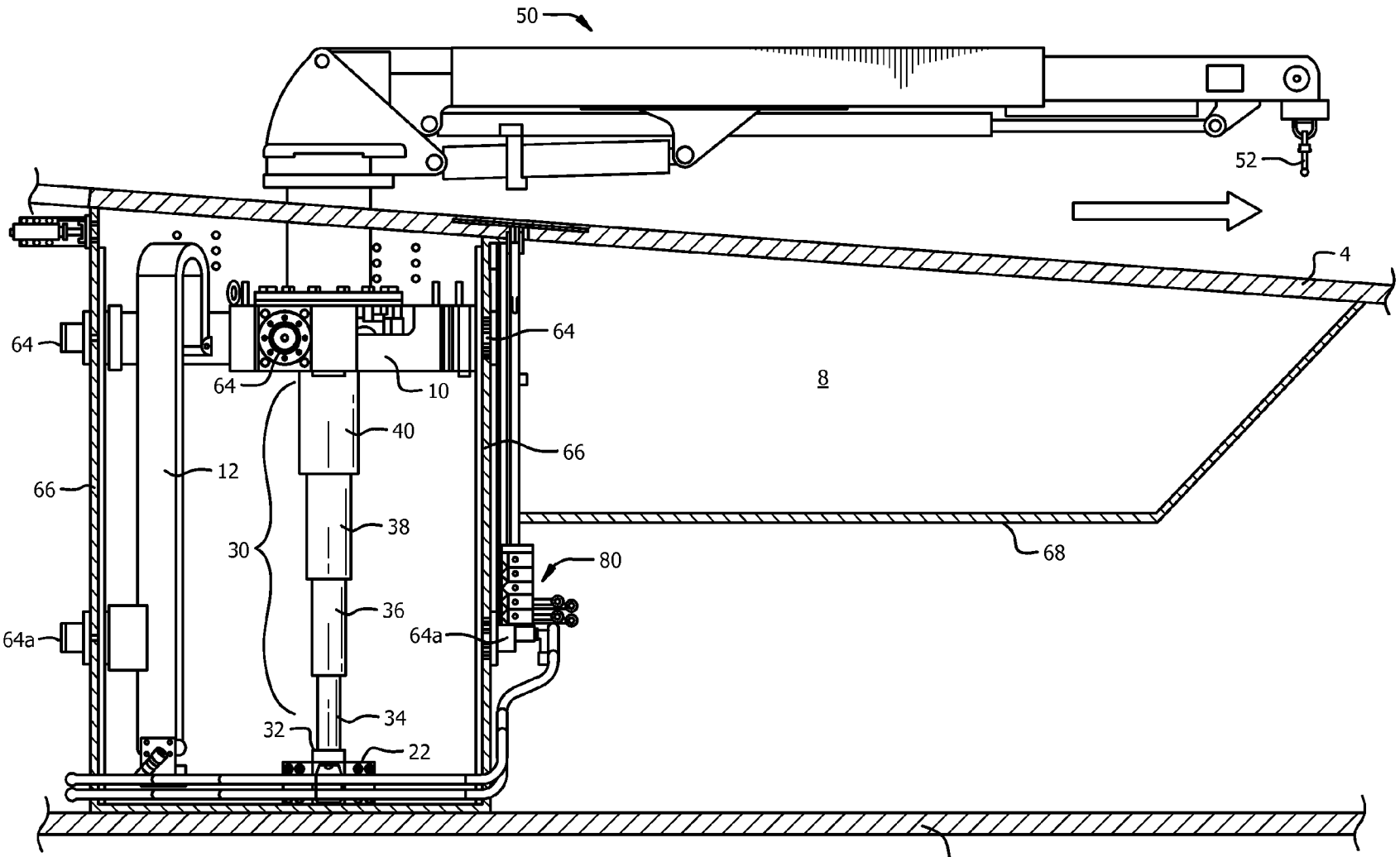
FIG. 2 illustrates a schematic view of the high-speed, reduced clearance lift with the payload deployed.
Figure 3:
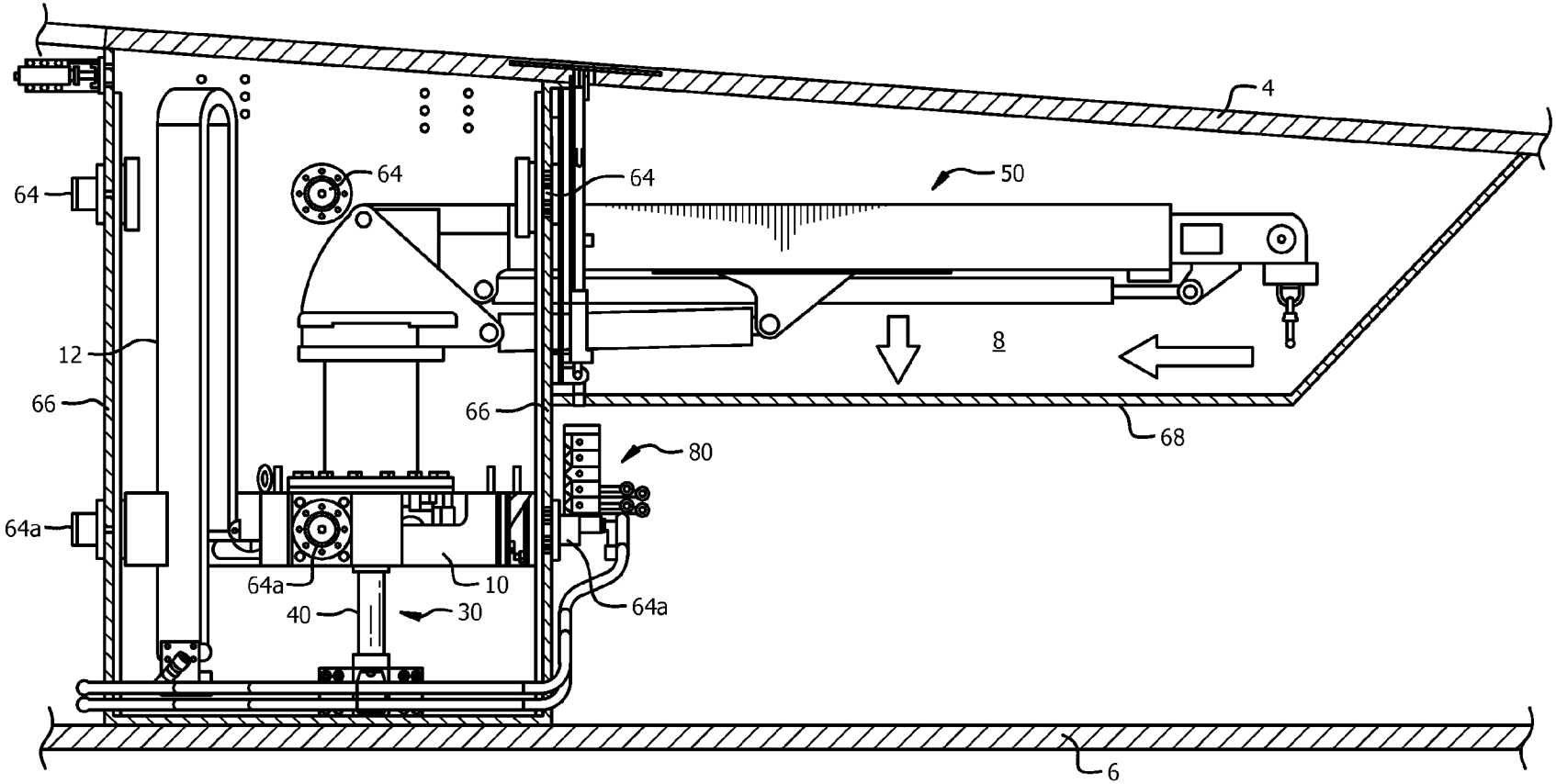
FIG. 3 illustrates a schematic view of the high-speed, reduced clearance lift with the payload retracted and stowed.
Figure 4A:
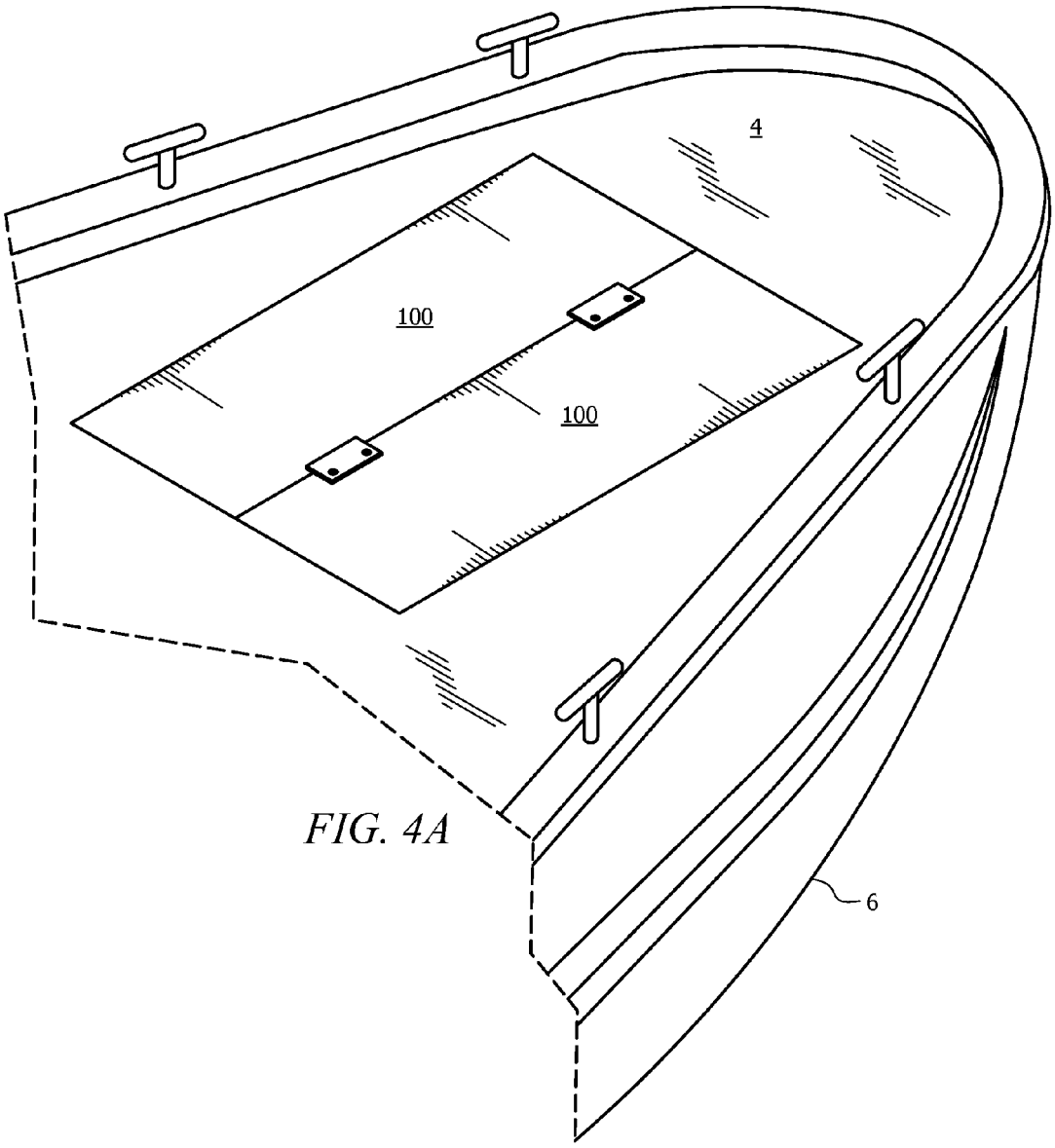
FIG. 4A illustrates a perspective view of a watercraft having the high-speed, reduced clearance lift with the payload retracted and stowed.
Figure 4B:
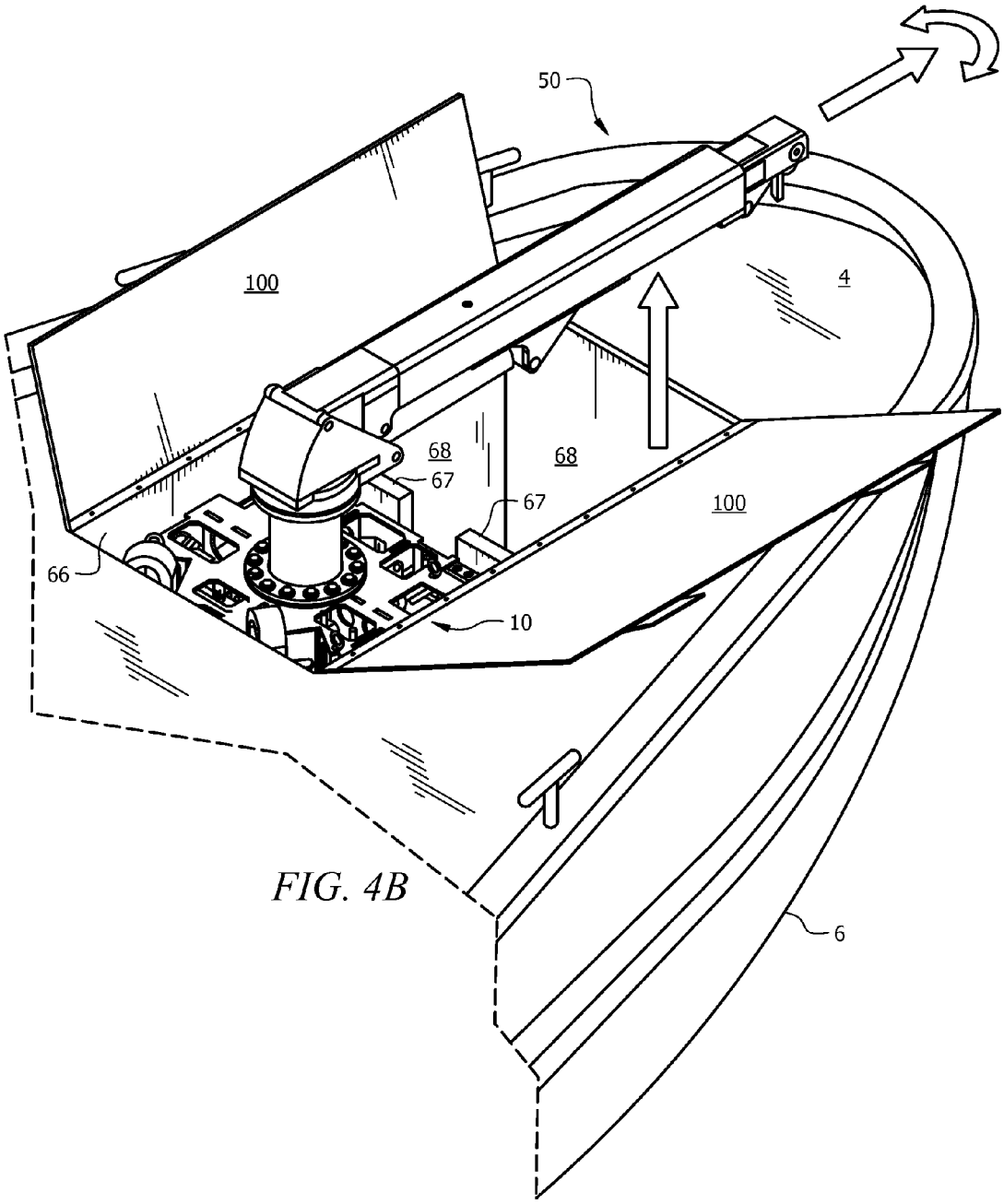
FIG. 4B illustrates a perspective view of a watercraft having the high-speed, reduced clearance lift with the payload deployed.

The high-speed, reduced clearance lift includes moving portions such as a lift platform 10 and stationary portions that are held to a structure such as the hull 6 and/or deck 4 of a watercraft (see FIGS. 2 and 3). In FIG. 1, the payload 50, which is shown as a crane 50, is supported by an optional rotary bearing that is bolted to the lift platform 10 so that the payload (crane) 50 is movable, for example, in an arc after the payload 50 is deployed as shown in FIGS. 2 and 4B. Hydraulic and, optionally, electrical connections to the lift platform 10 and/or to move and operate the payload 50 are made through bendable cables 12 that bend when the lift platform 10 is retracted and deployed (as shown in FIGS. 3 and 4A).

The lift platform 10 is deployed and retracted by way of a telescoping hydraulic ram 30. A first end 32 of the telescoping hydraulic ram 30 is anchored to the watercraft by, for example, a base member 20, affixed to the telescoping hydraulic ram 30 by a flange 22. The base member 20 is, for example, affixed to the hull 6 (or sub-deck) of the watercraft by any mechanism known, for example, by mounting plates 24 that are affixed (shown with bolt holes) to either the hull 6 of the watercraft, to surfaces of the lift frame 66 (see FIGS. 2, 3, and 4B), or to any suitable structure of the watercraft. The lift frame 66 also serves to guide and steady the lift platform 10, especially while transitioning of the lift platform 10 between a retracted position and a deployed position.

The upper, distal end (last segment 40-see FIG. 2) of the telescoping hydraulic ram 30 is connected to the lift platform 10 so that the lift platform 10 moves up/down (deploys or retracts) responsive to the segments 34/36/38/40 of the telescoping hydraulic ram 30 telescoping under hydraulic pressure or collapsing after abatement of the hydraulic pressure.

The telescoping hydraulic ram 30 is fabricated from multiple segments 34/36/38/40. Three segments 34/36/38 are visible in FIG. 1 and four segments 34/36/38/40 are shown in FIG. 2, though any number of segments 34/36/38/40 (at least two) are anticipated and included here within. As is understandable from the drawings (see FIGS. 2 and 3), by having segments 34/36/38/40, the length of the telescoping hydraulic ram 30 in the compressed state (see FIG. 3) is approximately the length of the tallest segment 40 (or the longest of the segments 34/36/38/40) and the length of the hydraulic ram 30 in the expanded state (see FIG. 2) is approximately the sum of the lengths of the segments 34/36/38/40 (minus any overlap required for seals and retaining of the segments 34/36/38/40 to adjacent segments 34/36/38/40). Although the segments 34/36/38/40 are shown being substantially the same height, there is no requirement that the segments 34/36/38/40 are all the same height. The telescoping hydraulic ram 30 lifts the payload (e.g. crane 50) multiples of the collapsed height of the telescoping hydraulic ram 30. This is an important feature, especially for watercraft, being that for many a watercraft; there is not sufficient head room (vertical space between the deck 4 and the hull 6) for a single-stage hydraulic ram. For example, if the payload 50 needs to be lifted 48 inches to clear the deck 4, a traditional hydraulic ram (not shown) must be over 48 inches in its compressed mode, allowing the piston to travel at least 48 inches. This requires at least 96 inches between the deck 4 and the hull 6 plus additional depth for connecting and support. The 96 inches include the space below deck for stowing the 48 inch payload and 48 inches below that for the non-telescoping hydraulic ram. Many watercraft do not have this much distance between the deck 4 and hull 6, especially when the hydraulic lift needs to be located close to the bow, where the deck 4 often approaches and/or meets the hull 6.

The telescoping hydraulic ram 30 shown in FIG. 2, having four segments 34/36/38/40, need only be approximately 24 inches high in order to raise the payload 50 by 48 inches.

The telescoping hydraulic ram 30 is provided with hydraulic pressure from a hydraulic pump (not shown) that is often already present on many a watercraft or from a separate hydraulic pump (not shown) or both. In some embodiments, hydraulic pressure is routed to the telescoping hydraulic ram 30 through bendable conduit 12 to accommodate the lifting and lowering of the lift platform 10.

Because watercraft are not very stable and level, especially in rough seas, there are locking pins 14, preferably located on each of the side surfaces of the lift platform 10. In the example shown, there are four locking pins 14, one on each side of the lift platform 10. The locking pins 14 are retracted by actuators when the lift platform 10 (and therefore the payload 50) is in motion between the deployed and retracted positions, allowing the lift platform 10 to move upward or downward within the lift frame 66. Once the lift platform 10 is positioned either in the deployed position (as in FIG. 2) or in the retracted position (as in FIG. 3), the locking pins 14 are extended outwardly from the lift platform 10 by actuators to engage within receivers **64/64*a* that are mounted on the lift frame 66. The locking pins 14 are extended in any way known, including hydraulically, magnetically, motor driven, etc. It is preferred, though not required, to include a beveled interface between the locking pins 14 and the receivers 64/64*a* to compensate for tolerances in the positioning of the lift platform 10 within the lift frame 66. Once the locking pins 14 are engaged into the receivers 64/64*a*, the lift platform 10 remains stationary within the lift frame 66 without the need for constant hydraulic pressure within the telescoping hydraulic ram 30. When the lift platform 10 and the payload 50 need to be moved (retracted or deployed), the locking pins 14 are retracted, for example, hydraulically, magnetically, by motor, etc., and are disengaged from the receivers 64/64*a***

Referring to FIG. 2, a schematic view of the high-speed, reduced clearance lift with the payload 50 deployed is shown. In this view, the telescoping hydraulic ram 30 has been pressurized to expand the segments 34/36/38/40 and, therefore, deploy the payload 50 (e.g. a crane 50 with winch attachment 52). Once the telescoping hydraulic ram 30 has deployed the payload 50 (as shown), the locking pins 14 are extended and mate with the upper receivers 64, securely holding the lift platform 10 (and payload 50) in the deployed position, at which time, in some embodiments, an abatement or lessening of hydraulic pressure provided to the telescoping hydraulic ram 30 is anticipated, being that the locking pins 14 extended into the upper receivers 64 are preferably designed with sufficient strength as to support the payload 50.

In FIG. 2, it is shown how the first end 32 of the telescoping hydraulic ram 30 is secured to the lift frame 66 by attachment plates 22, though any structural mounting scheme is anticipated. A hydraulic control panel 80 is also shown with controls for raising/lowering the lift platform 10 and for extending/retracting the locking pins 14. There is no restriction on the type of hydraulic controls 80 and/or the location of the hydraulic controls 80 within the watercraft.

Although not shown, the lift frame 66 is secured to and supported by the hull 6 and/or the deck 4, and/or any other structure of the watercraft, as needed for structural strength.

The payload 50 (e.g. crane 50) is shown deployed above the deck 4 and a cavity 8 is shown empty and ready to receive the payload 50 (e.g. crane 50) when the controls 80 are operated to release the locking pins 14 and retract the lift platform 10 and, consequently the payload 50. In some embodiments, the cavity 8 has walls 68 to enclose the cavity 8 and reduce penetration of water from weather or waves that wash over the cavity and into the hull of the boat while the payload 50 is deployed. In some such embodiments, the cavity 8 has drainage or pumps to remove such water.

Referring to FIG. 3, a schematic view of the high-speed, reduced clearance lift with the payload 50 retracted and stowed within the cavity 8 is shown. The payload 50 (e.g. crane 50) is shown retracted below the deck 4 and stowed within the cavity 8. As shown in FIGS. 4A and 4B, it is anticipated, though not required, that doors 100 cover the payload 50 and cavity 8, at least when the payload 50 is stowed beneath the deck 4, reducing water intrusion into the watercraft hull area and cavity 8. Once the lift platform 10 reaches the retracted position, the locking pins 14 are extended to engage with the lower receivers 64*a*, securing the lift platform 10 in position supported by the lower receivers 64*a* which receive structural support from, for example, the lift walls 66.

For payloads 50 that have arms that extend and retract (e.g. extend outwardly as the c50 that is shown in the figures), it is anticipated that the arms of the payload 50 be retracted before retracting the lift platform 10. In some embodiments, the retracting is automatic and required before movement of the lift platform 10 commences to prevent damage to the watercraft that would occur if the payload 50 is retracted while the payload 50 is in an extended position.

Referring to FIG. 4A, a perspective view of a watercraft having the high-speed, reduced clearance lift with the payload 50 retracted and stowed is shown. In this view, the payload 50 (e.g. crane 50) is not visible, covered by doors 100, and stowed below the deck 4. Although not required, by including one or more doors 100, when the payload is retracted 50, the payload 50 is not visible and the doors 100 reduce water intrusion into the hull 6. There are many ways anticipated for opening the doors 100, including, but not limited to, motor or hydraulic drives (not shown), manual operation, and by the payload 50 pushing the doors 100 to the open position. Likewise, the same or different ways are anticipated for closing the doors 100 during or after retraction of the payload 50, including, but not limited to, motor or hydraulic drives (not shown), manual operation, and by the payload 50 retracting, in which the doors 100 move to the closed position by tethers (e.g. attached to the lift platform 10) or by springs, etc.

Referring to FIG. 4B, a perspective view of a watercraft having the high-speed, reduced clearance lift with the payload 50 (e.g. crane 50) deployed is shown. In this view, the doors 100 are open and the payload 50 is deployed. In this example using a crane 50 as the payload 50, it is anticipated that the crane 50 is extended outwardly and/or rotated left/right to position the winch 52 over an object that is to be lifted in or out of the water or a dock, etc. In this view, the walls 68 of the cavity 8 are visible as is the top surface of the lift deck 10. The walls of lift frame 66 are also visible. Note that the forward wall of the lift frame 67 is notched to allow for the payload to be lowered into the cavity 8.

Although not shown, in some embodiments, vertical rails are provided and the lift platform 10 has orifices that engage with the vertical rails to steady the lift platform 10 during transitions between the retracted position and the deployed position.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A high speed, reduced clearance lift system comprising:
a lift platform;
a lift frame for guiding and containing the lift platform;
a telescoping hydraulic ram having at least three telescoping sections, a first end of the telescoping hydraulic ram interfaced to the lift platform and a second end of the telescoping hydraulic ram interfaced to a structural member such that, hydraulic fluid pressure introduced into the telescoping hydraulic ram forces the at least three telescoping sections to extend, thereby raising the lift platform into a deployed position, and abatement of the hydraulic fluid pressure allows the at least three telescoping sections to collapse, thereby lowering the lift platform to a retracted position; and
means for locking the lift platform in the deployed position, the means for locking the lift platform in the deployed position comprising actuated locking pins that removably seat in receivers.

2. The high speed, reduced clearance lift system of claim 1, further comprising means for locking the lift platform in the retracted position.

3. The high speed, reduced clearance lift system of claim 2, wherein the means for locking the lift platform in the retracted position comprises actuated locking pins that removably seat in receivers.

4. The high speed, reduced clearance lift system of claim 1, wherein the locking pins are affixed to the lift platform and the receivers are affixed to the lift frame.

5. The high speed, reduced clearance lift system of claim 3, wherein the locking pins are affixed to the lift platform and the receivers are affixed to the lift frame.

6. The high speed, reduced clearance lift system of claim 1, further comprising a payload affixed to the lift platform, the payload moving between the retracted position and the deployed position with the lift platform.

7. The high speed, reduced clearance lift system of claim 6, wherein the payload is a crane.

8. The high speed, reduced clearance lift system of claim 6, further comprising a door system that covers the payload when the lift platform is in the retracted position.

9. A high speed, reduced clearance lift system for a watercraft, the high speed, reduced clearance lift system comprising:

a lift platform;

a lift frame for guiding and containing the lift platform, the lift frame structurally interfaced to a hull of a watercraft;

a telescoping hydraulic ram having at least three telescoping sections, a first end of the telescoping hydraulic ram interfaced to a bottom of the lift platform and a second end of the telescoping hydraulic ram interfaced to the hull of the watercraft such that, hydraulic fluid pressure introduced into the telescoping hydraulic ram forces the at least three telescoping sections to extend, thereby raising the lift platform into a deployed position, and abating of the hydraulic fluid pressure allows the at least three telescoping sections to collapse, thereby lowering the lift platform to a retracted position;

a plurality of locking pin receivers interfaced to the frame in a location where the lift platform rests when the frame is in the deployed position; and a plurality of locking pins interfaced to sides of the lift platform, each of the locking pins actuated to removably engage with a corresponding one of the plurality of locking pin receivers when the lift platform is in the deployed position.

10. The high speed, reduced clearance lift system of claim 9, further comprising a second plurality of locking pin receivers interfaced to the frame in a second location where the frame rests when the frame is in the deployed position, each of the plurality of locking pins also actuated to removably engage with a corresponding one of the second plurality of locking pin receivers when the lift platform is in the retracted position.

11. The high speed, reduced clearance lift system of claim 9, wherein the at least three telescoping sections are four telescoping sections.

12. The high speed, reduced clearance lift system of claim 9, wherein lift platform has four sides and one of the plurality of locking pins is interfaced to each of the four sides.

13. The high speed, reduced clearance lift system of claim 9, further comprising a payload, the payload rotatably interfaced to a top of the lift platform, the top of the lift platform being directly opposite of the bottom of the lift platform.

* * * * *